US011745209B2

(12) United States Patent
McIver

(10) Patent No.: US 11,745,209 B2
(45) Date of Patent: Sep. 5, 2023

(54) SPRINKLER ENCLOSURE DEVICE

(71) Applicant: Andrew Wyche McIver, Altamonte Springs, FL (US)

(72) Inventor: Andrew Wyche McIver, Altamonte Springs, FL (US)

(73) Assignee: Cicada Holdings, LLC, Altamonte Springs, FL (US)

( * ) Notice: Subject to any disclaimer, the term of this patent is extended or adjusted under 35 U.S.C. 154(b) by 0 days.

(21) Appl. No.: 17/738,762

(22) Filed: May 6, 2022

(65) Prior Publication Data

US 2022/0258195 A1 Aug. 18, 2022

Related U.S. Application Data

(63) Continuation-in-part of application No. 16/875,300, filed on May 15, 2020, now Pat. No. 11,344,905.

(51) Int. Cl.
*B05B 15/65* (2018.01)
*B05B 15/622* (2018.01)

(52) U.S. Cl.
CPC ..... *B05B 15/65* (2018.02); *B05B 15/622* (2018.02)

(58) Field of Classification Search
CPC ..... B05B 15/74; B05B 15/65; B05B 15/622; B05B 1/28; B05B 12/16; B05B 12/32
USPC ..... 239/288–288.5, 200, 201, 203–206, 600
See application file for complete search history.

(56) References Cited

U.S. PATENT DOCUMENTS

| | | | | |
|---|---|---|---|---|
| 3,015,448 | A * | 1/1962 | Hurless | A01G 25/00 239/288.5 |
| 4,429,832 | A * | 2/1984 | Sheets | B05B 15/74 239/288.5 |
| 4,781,327 | A * | 11/1988 | Lawson | B05B 3/0477 239/206 |
| 5,938,121 | A | 8/1999 | Ferguson et al. | |
| 6,764,025 | B1 | 7/2004 | Espina | |
| 7,114,665 | B1 | 10/2006 | Tee | |
| 7,617,994 | B2 * | 11/2009 | Gunderson | A01G 25/06 239/206 |
| 7,717,360 | B1 | 5/2010 | Kander | |
| 9,149,825 | B1 * | 10/2015 | Blakeslee | B05B 15/16 |
| 10,919,068 | B1 | 2/2021 | Newmeyer | |
| 2005/0023375 | A1 | 2/2005 | Tanczos | |
| 2014/0290028 | A1 | 10/2014 | Ishaya et al. | |

* cited by examiner

*Primary Examiner* — Steven J Ganey
(74) *Attorney, Agent, or Firm* — Jason T. Daniel, Esq.; Daniel Law Offices, P.A.

(57) ABSTRACT

A sprinkler enclosure device includes a baseplate and a generally hollow cup extending upward therefrom in a perpendicular manner. The cup includes an inside diameter that is suitable for receiving a sprinkler body, and a height that is suitable for receiving at least a portion of the sprinkler body. The baseplate includes a central aperture for receiving the cup. The cup includes a central aperture having dimensions suitable for receiving an irrigation fitting for connecting the sprinkler body positioned within the cup to an irrigation water supply line. A sealing ring is removably positioned along the top end of the cup and includes a central opening having a diameter that is complementary to the outside diameter of the received sprinkler body. The sealing ring preventing dirt from entering the interior space of the cup.

11 Claims, 8 Drawing Sheets

SPRINKLER ENCLOSURE DEVICE

CROSS-REFERENCE TO RELATED APPLICATIONS

This application is a continuation-in-part of and claims the benefit to U.S. application Ser. No. 16/875,300 filed on May 15, 2020, the contents of which are fully incorporated herein by reference.

TECHNICAL FIELD

The present invention relates generally to irrigation systems, and more particularly to a sprinkler enclosure device for aiding in the maintenance and/or replacement of yard sprinklers.

BACKGROUND

The statements in this section merely provide background information related to the present disclosure and may not constitute prior art.

Underground irrigation systems are utilized throughout the world to provide water to lawns and gardens in both home and commercial settings. Such systems typically employ a plurality of underground (typically PVC) supply lines which route water from a source to a plurality of sprinkler heads.

The most common type of sprinkler heads are known as "pop-up" heads, and typically comprise a main body that is positioned underground having a bottom section that connects to the water supply line. A retractable riser is telescopically connected to the main body so as to also remain underground when not in use. Upon receiving water from the supply line, the riser extends above the surface of the ground to dispense the water through a nozzle to the surrounding area.

Sprinkler heads are typically constructed from thin, lightweight plastic, which become brittle over time. As such, it is not uncommon for one or more sprinkler heads to become damaged by activities such as lawn mowing, raking and trimming, for example. When this occurs, it becomes necessary to replace the sprinkler head. This is traditionally accomplished by first digging the ground around the buried sprinkler body, unscrewing the sprinkler body from the supply line, screwing a replacing sprinkler to the supply line, and then filling in the dirt around the new sprinkler.

Although straightforward in appearance, this procedure often results in two significant problems. First, users often struggle to properly connect the new sprinkler to the existing supply line. This is often the result of dirt and mud within the exposed hole that affects the ability of the threads to properly engage. As such, many users cross-thread the sprinkler resulting in an underground leak that affects the performance of the sprinkler, wastes water and may not be immediately detected.

A second problem is that many users find it extremely difficult to properly position the new sprinkler head in a purely vertical manner, as the loose soil has a tendency to cause the sprinkler to shift. When this occurs, the water spraying from the new sprinkler is not able to reach the entire area assigned to it, which often results in damage to grass and plants.

Accordingly, it would be beneficial to provide a sprinkler enclosure device which can function to aid users in the maintenance and replacement of yard sprinklers, so as to overcome the drawbacks described above.

SUMMARY OF THE INVENTION

The present invention is directed to a sprinkler enclosure device. One embodiment of the present invention can include a wide baseplate and a generally hollow cup extending upward therefrom in a perpendicular manner. The cup can include an inside diameter that is suitable for receiving a sprinkler body, and the cup can include a height that is suitable for receiving at least a portion of the sprinkler body.

In one embodiment, the baseplate includes a central aperture for receiving the cup, and the cup can include a centrally located aperture having dimensions suitable for receiving an irrigation fitting for securing a sprinkler body positioned within the cup to an irrigation water supply line.

In one embodiment, a sealing ring can be removably positioned along the top end of the cup. The sealing ring can include a central opening having a diameter that is complementary to the outside diameter of the received sprinkler body and can function to preventing dirt from entering the interior space of the cup. The sprinkler can be connected to the fitting within the cup body and can be positioned and maintained in a purely vertical orientation by the baseplate.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
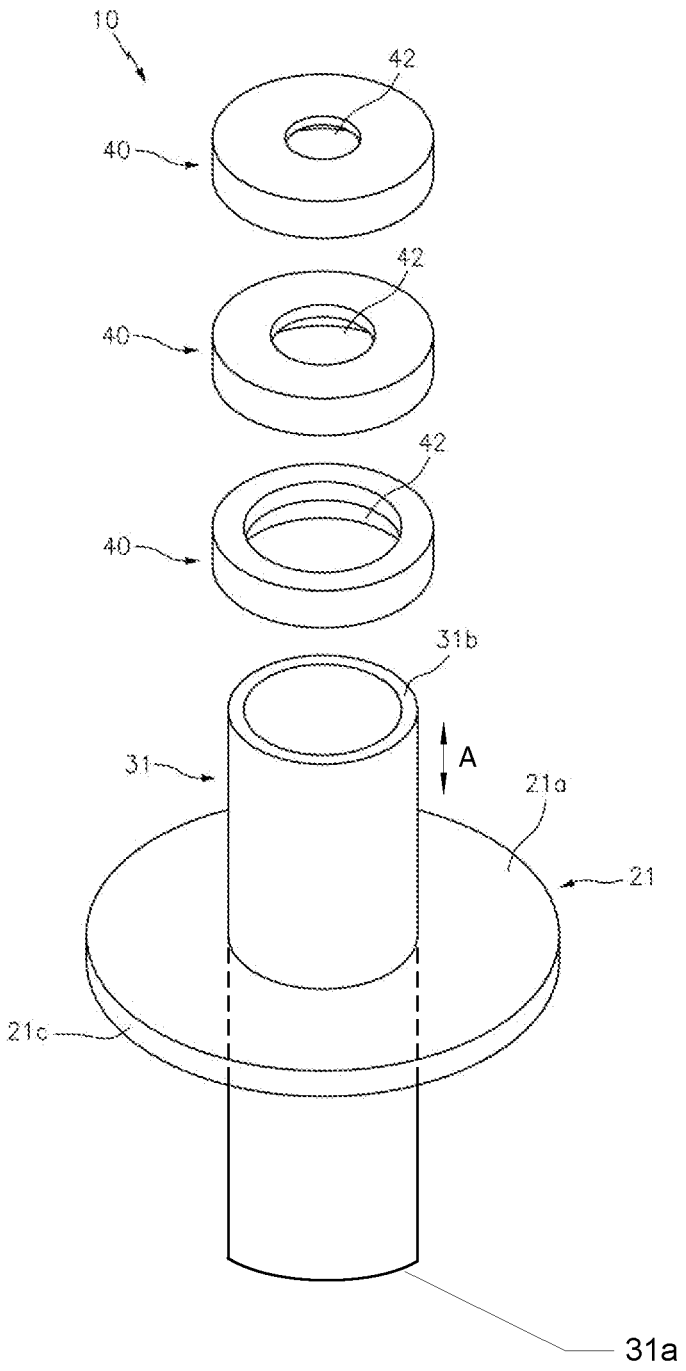
FIG. 1 is a perspective view of a sprinkler enclosure device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting, but rather to provide an understandable description of the invention.

Definitions

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the terms "connector" and "complementary connector" include any number of different elements that work together to repeatedly join two items together in a non-permanent manner. Several nonlimiting examples include opposing strips of hook and loop material (i.e., Velcro®), attractively-oriented magnetic elements, flexible strips of interlocking projections with a slider (i.e., zipper), tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

As described herein, the term "industry standard" refers to the established standard, norm, or requirement within this particular area of business. In the present example, the industry standard refers to the standardized sizing and schedules for PVC pipes and fittings used by virtually every major manufacturer within the irrigation industry.

FIGS. 1-5B illustrate one embodiment of a sprinkler enclosure device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown throughout the drawings, one embodiment of a sprinkler enclosure device 10 can include a baseplate 21, a centrally located cup 31, and one or more sealing rings 40.

The baseplate 21 can function to provide a stable, free-standing platform for maintaining the device in a vertical orientation when installed within the ground. In one embodiment, the baseplate 21 can include a unitary, and generally circular-shaped member having a top surface 21*a*, a bottom surface 21*b*, a continuous sidewall 21*c*, and a central aperture 22.

In the preferred embodiment, the baseplate can include a generally planar construction. Of course, other embodiments are contemplated where the baseplate includes an upward bend wherein the sidewall 21*c* is positioned lower than the central aperture 22. Such a feature providing additional structural support and further functions to prevent a sloped surface for preventing water from accumulating on the top of the baseplate.

Although not specifically illustrated, the baseplate can include a plurality of pre-scored holes so as to allow a user to cut, fold, bend or otherwise break the baseplate along the series of holes in order to adjust the shape of the baseplate. Such a feature being particularly advantageous for situations where the baseplate is being installed adjacent to a structure such as a house or mailbox, for example, and the cup needs to be located closer to the structure.

In the preferred embodiment, the central aperture 22 will be constructed so as to include a shape and size that is complementary to or slightly larger than the cross-sectional dimension of the below described central cup, so as to allow the cup to be positioned through the aperture 22. As shown by arrow A, the cup will be able to move vertically through the central aperture 22 relative to the baseplate (i.e., slidingly positioned).

Figure 2:
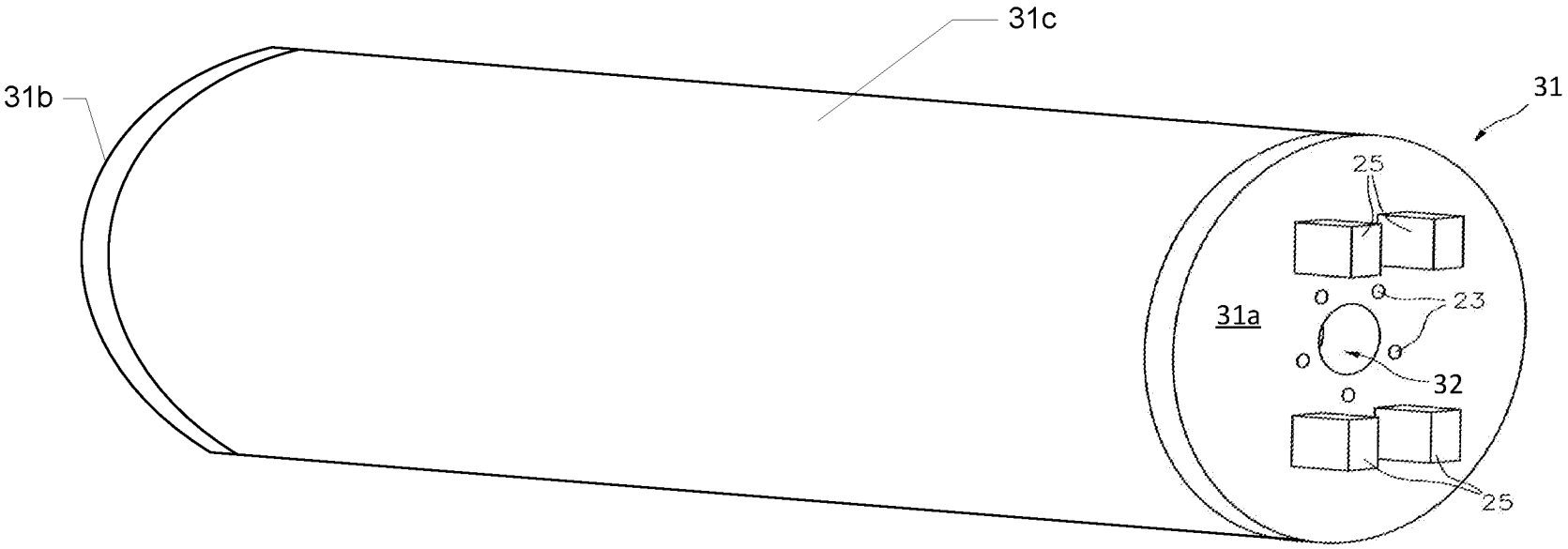
FIG. 2 is a bottom perspective view of the sprinkler enclosure device, in accordance with one embodiment of the invention.
Figure 3:
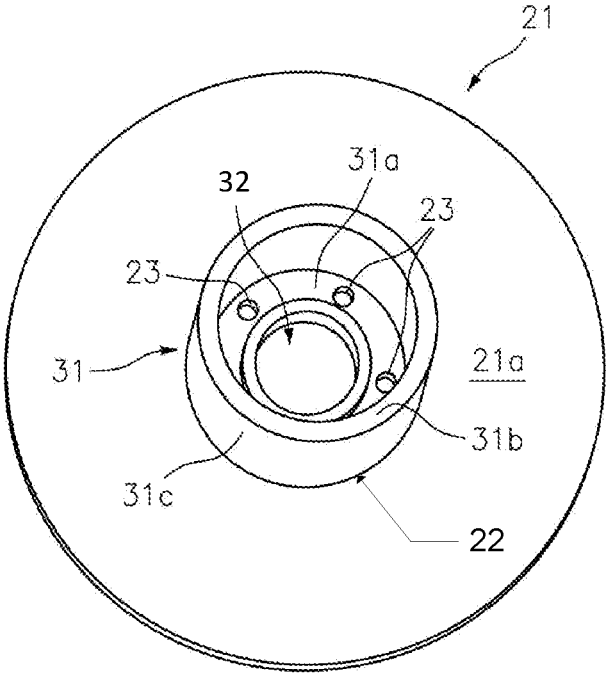
FIG. 3 is a top view of the sprinkler enclosure device, in accordance with one embodiment of the invention.

As shown best at FIGS. 2 and 3, the central cup 31 can include a generally cylindrical shaped member having a bottom end 31*a*, an open top end 31*b* and a continuous sidewall 31*c*. The cup can also include an aperture 32 that is positioned along the center of the bottom surface 31*a*. In the preferred embodiment, the central aperture 32 will be constructed so as to include a shape and size that is complementary to or slightly larger than the cross-sectional dimensions of an industry standard irrigational fitting such as a ½" or ¾" threaded PVC fitting, for example. To this end, the central aperture is constructed so as to allow a portion of, or the entire fitting to be positioned therethrough, so as to be ultimately engaged by the bottom end of a sprinkler.

In one embodiment, a plurality of drain holes 23 can also be positioned along the periphery of the central aperture 32 so as to allow any water within the cup to pass through the device and into the ground beneath.

As described herein, the baseplate 21 and central cup 31 may each be formed from materials that are, for example, relatively strong and stiff for their weight, and that are suitable for prolonged exposure to wet underground environments. Several nonlimiting examples include but are not limited to various metals or metal alloys (e.g., aluminum, steel, titanium, or alloys thereof), plastic/polymers (e.g., high-density polyethylene (HDPE), rigid polyvinyl chloride (PVC), or polyethylene terephthalate (PET)), and/or various composite materials (e.g., carbon fibers in a polymer matrix, fiberglass, etc.). In the preferred embodiment, elements 21 and 31 will be formed as separate components that are removably connected together.

In one embodiment, a plurality of protrusions 25 can extend downward from one or both of the bottom surface 21*b* of the baseplate and/or the bottom end of the cup 31*a*. Protrusions 25 can function as holding tabs for engaging a portion (preferably both sides) of an irrigation line or fitting that is positioned through the aperture 32. In this regard, the protrusions 25 can prevent movement and/or twisting of a fitting when a user attempts to install or remove a sprinkler from the fitting. The protrusions also advantageously functioning as an anchor for preventing a twisting movement of the baseplate itself.

The sealing ring 40 can function to engage both the cup 31 and an installed sprinkler so as to prevent dirt and other detritus from entering the cup area and making contact with an irrigation fitting positioned therein. More specifically, the sealing ring can function to keep the threads of an irrigation fitting free from dirt, so as to allow easy attachment to a replacement sprinkler head. As described herein, the sealing ring can be constructed from the same material as the baseplate 21 or can be constructed from a different material. For example, the sealing ring can be constructed from a resilient plastic material, so as to be capable of flexing in order to accommodate sprinkler bodies of varying sizes.

Figure 4A:
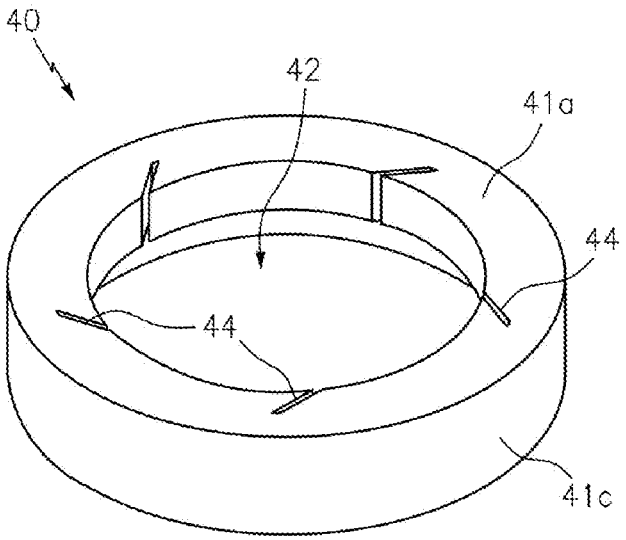
FIG. 4A is a perspective view of the sealing ring of the sprinkler enclosure device, in accordance with one embodiment of the invention.
Figure 4B:
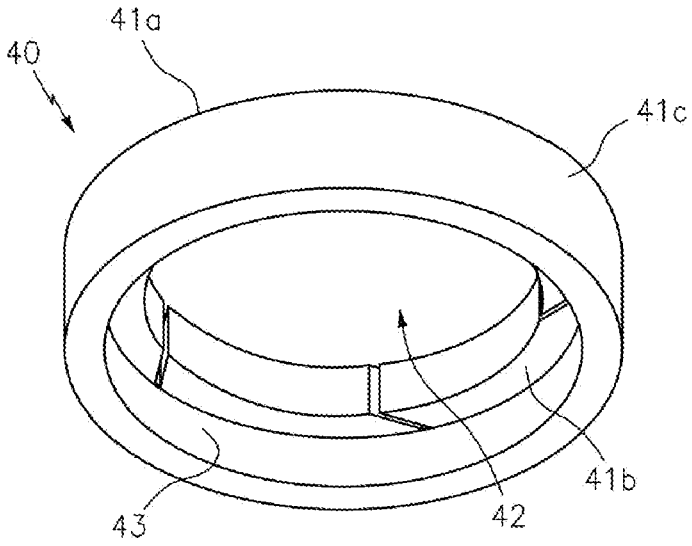
FIG. 4B is another perspective view of the sealing ring of the sprinkler enclosure device, in accordance with one embodiment of the invention.

As shown at FIGS. 4A and 4B, the sealing ring 40 can include a generally circular shaped body having a top surface 41*a*, a bottom surface 41*b*, a continuous sidewall 41*c* and a central opening 42. In one embodiment, a portion of the continuous sidewall 43 can extend beyond the bottom surface 41*b* and can include an inside diameter that is complementary to the outside diameter of the cup body 31*c*.

As described herein, the central aperture 42 can include any number of shapes and sizes suitable for receiving the main body of a commercially available sprinkler head. To this end, the central opening 42 may be sized specifically to be complementary to the cross-sectional dimension of a particular type, brand or class of sprinkler head body, and/or may be sized so as to receive a plurality of different type, brand or class of sprinkler head bodies.

In one embodiment, the ring 40 may include one or more expansion cuts 44 that can extend from the central aperture 42 along the top surface 41*a* toward the sidewall 41*c*. The expansion cuts functioning to allow the shape and size of the central aperture to be adjusted to fit larger sprinkler bodies through a bending of the cut material.

In one embodiment (See FIG. 1), the system 10 may be provided with multiple individual sealing rings 40, each having different shaped and/or sized opening 42 so as to conform to different shaped and sized sprinkler body sizes.

Figure 4C:
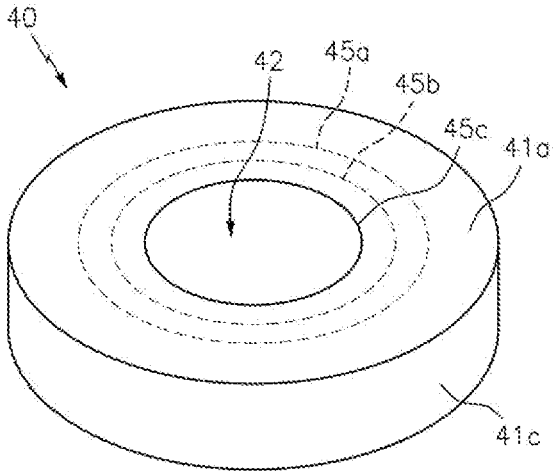
FIG. 4C is yet another perspective view of the sealing ring of the sprinkler enclosure device, in accordance with one embodiment of the invention.

In one embodiment, shown at FIG. 4C, a plurality of removable tabs 45*a*-45*c* can be positioned within the central opening 42. Each of the tabs can be removably secured to either an adjacent tab or to the top surface 41*b* via a plurality of pre-scored holes, for example, so as to allow a user to adjust the size of the resulting opening by simply pulling and removing one or more of the tabs. In this regard, a single sealing ring 40 can be sized to fit multiple different types, brands or classes of sprinkler head bodies by simply removing one or more of the individual tabs.

Figure 5A:
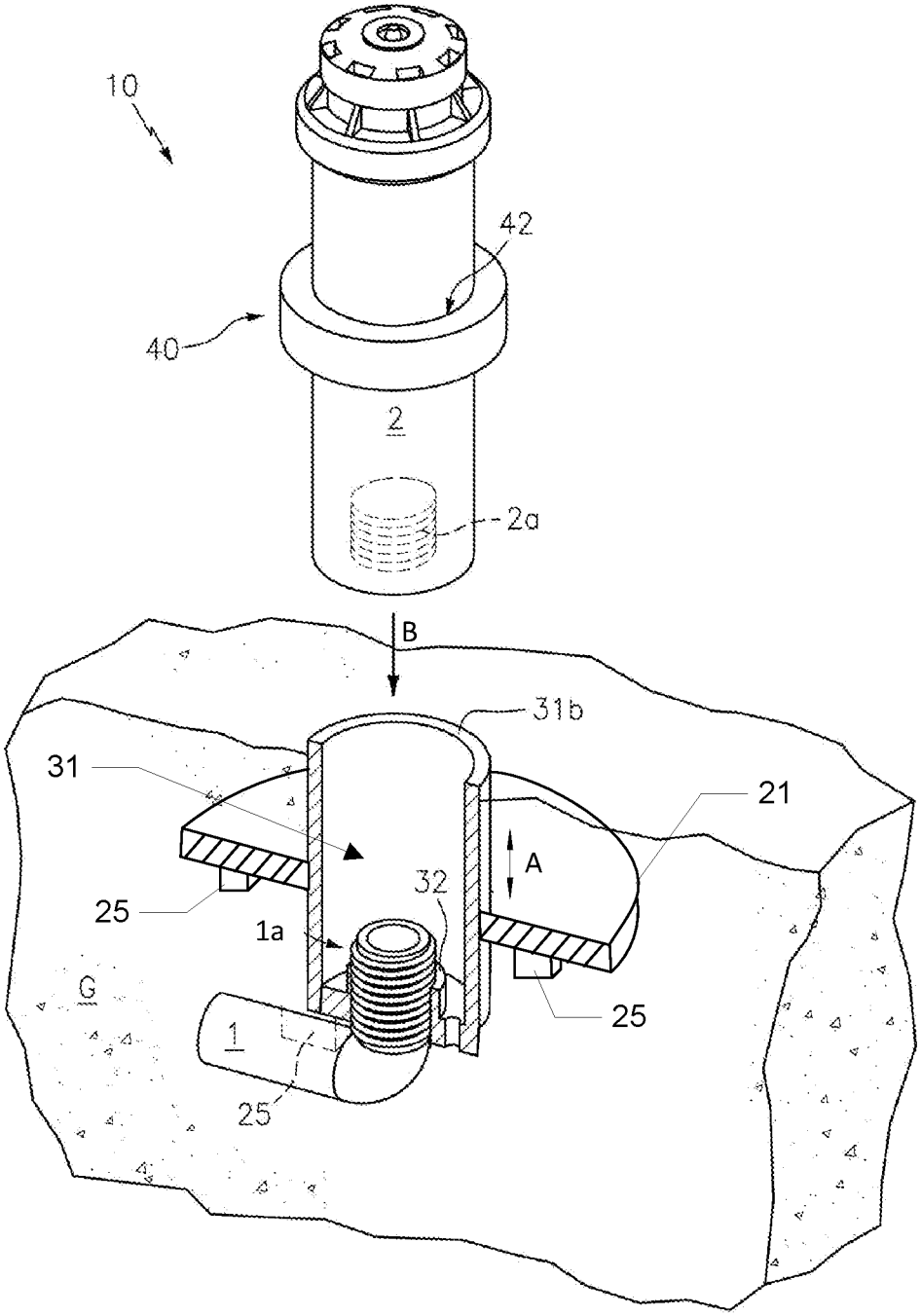
FIG. 5A is a side view of the sprinkler enclosure device in operation, in accordance with one embodiment of the invention.
Figure 5B:
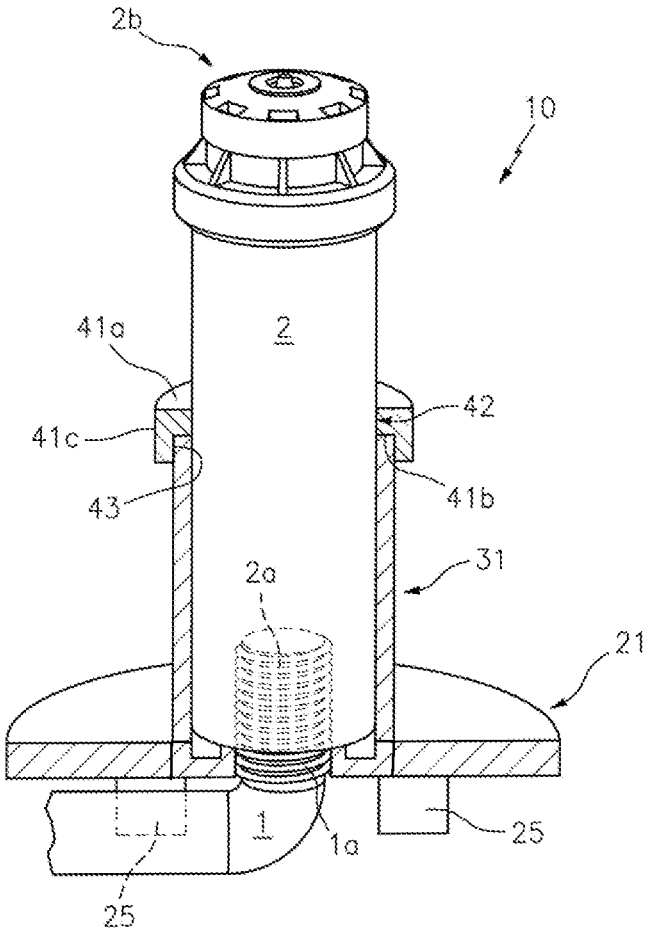
FIG. 5B is another side view of the sprinkler enclosure device in operation, in accordance with one embodiment of the invention.

FIGS. 5A and 5B illustrate one embodiment of the system 10 in operation. As shown, the cup can be positioned through the central aperture of the baseplate 21 and both components can be positioned along or within the ground G so as to be coupled to the supply line(s) of an irrigation system. In the preferred embodiment, a pipe fitting coupler 1 can be positioned through aperture 32 such that the threaded elements 1*a* of the fitting are located within the cup body 31.

Next, the main body 2 of a sprinkler head can be positioned through the central aperture 42 of the sealing ring, and the main body 2 can be lowered (arrow a) into the cup 31 until the threaded receiver 2*a* of the sprinkler head make contact with the fitting threads 1*a*. Upon making contact, the sprinkler can be twisted to secure the sprinkler to the supply fitting.

When so positioned, the head 2*b* of the sprinkler will be positioned above the top surface of the sealing ring 40, and the remainder of the sprinkler body will be enclosed entirely or partially within the cup body. In this regard, because the aperture 42 is sized to be complementary to the dimension of the sprinkler body, dirt and other detritus will not be able to enter the cup body, thus keeping the threaded fittings 1*a* and 2*a* clean.

Finally, because of the large surface area of the baseplate 21, which is preferably 1.5-4 times larger than the dimension of the cup 31, the same can position the sprinkler in a purely vertical orientation for use, so as to prevent water, or the force of the water exiting the sprinkler from tilting the sprinkler body in the dirt.

Moreover, because the cup 31 can move vertically relative to the baseplate 21, the system is able to withstand large amounts of weight without breaking. For example, if a car or lawnmower were to run over the top of the sprinkler and cup, the same can flex or move down into the ground independent of the baseplate. Such a feature providing resilience to the device components to prevent damage or breaking of the same.

Figure 6:
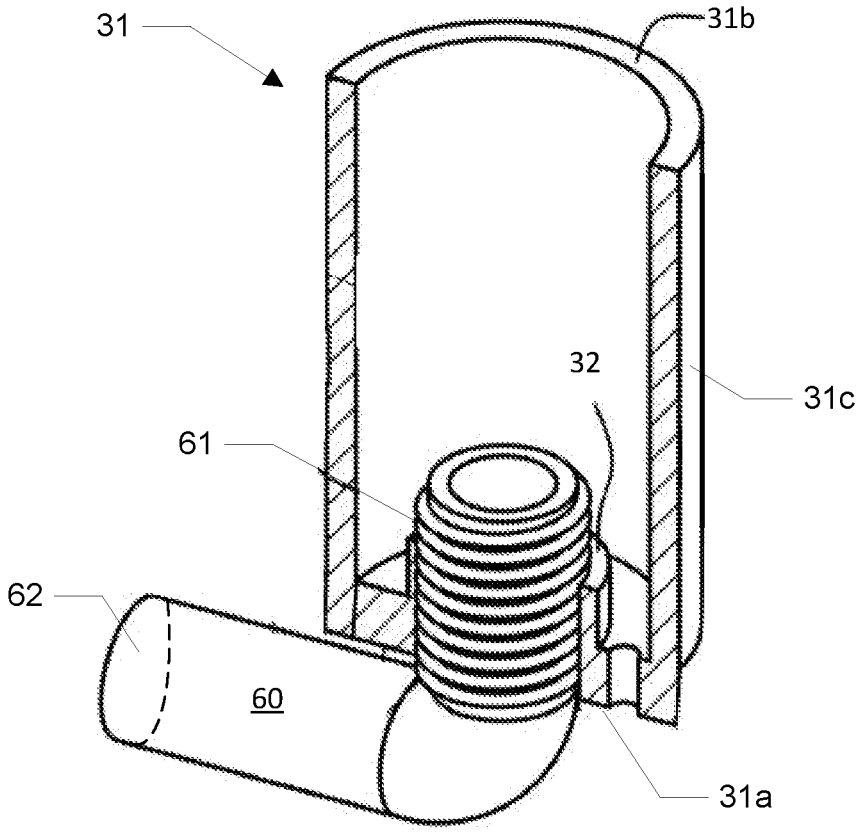
FIG. 6 is a cross sectional cutout view of the cup portion of the sprinkler enclosure device, in accordance with one embodiment of the invention.

Although described above as including an aperture 32 for removably receiving a separate pipe fitting coupler 1, other embodiments are contemplated. To this end, FIG. 6 illustrates one embodiment of the cup 31 that includes an integrated fitting coupler 60 that is permanently located through the aperture 32 on the bottom end 31*a* of the cup. As shown, the fitting coupler can include a plurality of male threads 61 positioned within the cup body for engaging a sprinkler in the manner described above. Likewise, the coupler can include an open second end 62 for engaging a water supply line of an irrigation system.

Although illustrated with regard to an elbow-style coupler wherein the first end 61 is oriented 90 degrees relative to the second end 62, this is for illustrative purposes only, as the integrated coupler can include any number of different shapes such as 45 degrees (e.g., diagonal) or 180 degrees (e.g., straight), for example so as to engage underground supply lines from various different positions.

Additionally, both ends of the coupler can include a shape and size that is complementary to the cross-sectional dimensions of any number of irrigational fittings and supply lines such as those formed using industry standard ½", ¾" or 1", among others, for example. Although not specifically illustrated, open end 62 may include a plurality of female threads (e.g., threads located inside the open end) for engaging supply lines having male threads.

Although dimensions are not critical, in one preferred embodiment, the cup 31 can include a height (e.g. distance between top and bottom ends) of about 2¾", the baseplate 21 can include an outside diameter of about 4¾", the cup can include an inside diameter of about 3", the aperture 42 of the sealing ring 40 can include an inside diameter of between about 2" to 2¾", and the apertures 22 and 32 can each include a diameter of about ¾" to 1¼".

Such dimensions being specifically chosen to produce a single sprinkler enclosure device 10 that is sized to accommodate the majority of commercially available 2" to 8" pop-up sprinkler heads and corresponding ½" to ¾" threaded PVC supply fittings that are manufactured for use in the residential market. Of course, other dimensions are contemplated for receiving different sized components.

Accordingly, the above-described sprinkler enclosure device 10 provides a novel solution for assisting users to maintain and replace sprinkler components that is not rendered obvious by any known art.

As described herein, one or more elements of the sprinkler enclosure device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A sprinkler enclosure device, comprising:

a baseplate having a top surface, a bottom surface, an outer wall, and a central aperture;

a cup having an open top end, a continuous sidewall, and a cup aperture along a bottom surface;

at least one sealing ring that is configured to be removably secured along the open top end of the cup; and a plurality of protrusions that are positioned along the bottom surface of the baseplate, wherein the cup is configured to be positioned through the central aperture of the baseplate, wherein the cup aperture is configured to receive an irrigation fitting, and wherein the plurality of protrusions are configured to selectively extend beyond the bottom surface of the cup and to engage an irrigation line connected to the irrigation fitting.

2. The device of claim 1, wherein the cup is slidingly positioned within the central aperture of the baseplate.

3. The device of claim 1, wherein the cup aperture includes a diameter that is complementary to a diameter of the irrigation fitting.

4. The device of claim 1, wherein the open top end of the cup is configured to receive a sprinkler body.

5. The device of claim 1, wherein the at least one sealing ring comprises:

a top surface, a bottom surface, and a central opening.

6. The device of claim 5, wherein the central opening of each of the at least one sealing ring includes a size that is configured to receive a sprinkler body.

7. The device of claim 6, wherein the central opening of each of the at least one sealing ring includes a dimension that is complementary to an outside diameter of the sprinkler body.

8. The device of claim 7, wherein the cup includes a height that is complementary to a height of the sprinkler body.

9. The device of claim 1, wherein the cup is positioned orthogonally to the baseplate.

10. The device of claim 9, further comprising:

a plurality of drain holes that are positioned throughout the baseplate.

11. The device of claim 1, further comprising:

another plurality of protrusions that are positioned along the bottom surface of the cup, said another plurality of protrusions also being configured to engage the irrigation line connected to the irrigation fitting.

* * * * *